United States Patent [19]

Jeter

[11] Patent Number: 5,070,651

[45] Date of Patent: Dec. 10, 1991

[54] DOOR FRAME ASSEMBLY

[76] Inventor: Gregory L. Jeter, 15407 Forest Trails, Houston, Tex. 77095

[21] Appl. No.: 637,544

[22] Filed: Jan. 4, 1991

[51] Int. Cl.[5] ..... F06B 1/04

[52] U.S. Cl. ..... 49/505

[58] Field of Search ..... 49/504, 505, 382; 52/211, 212, 213, 217

[56] References Cited

U.S. PATENT DOCUMENTS

| | | | |
|---|---|---|---|
| 2,990,040 | 6/1961 | Stevenson | 52/212 |
| 3,401,487 | 9/1968 | Brandt et al. | 49/505 X |
| 3,520,085 | 7/1970 | Pond | 49/505 |
| 3,681,876 | 8/1972 | Linder et al. | 49/504 |
| 3,774,345 | 11/1973 | Cole et al. | 49/504 |
| 3,906,671 | 9/1975 | Maldonado | 49/505 |
| 4,236,354 | 11/1980 | Passovoy | 49/504 |
| 4,281,480 | 8/1981 | Wendt | 49/504 |
| 4,369,600 | 1/1983 | Passovoy | 49/504 |
| 4,376,354 | 3/1983 | Passovoy | 49/504 |
| 4,589,229 | 5/1986 | Warren | 49/505 |
| 4,782,630 | 11/1988 | Kleyn | 49/505 |

*Primary Examiner*—Rodney M. Lindsey
*Assistant Examiner*—Jerry Redman
*Attorney, Agent, or Firm*—Richard C. Litman

[57] ABSTRACT

A channel assembly for framing a doorway includes a primary frame element having adjacent inside and outside channel sections respectively provided with trim sections adapted to overlie inside and outside walls. A separate door stop member includes hook elements engageable with catch devices integral with one such channel section to permit removable attachment of the stop member. Hinge and strike provisions are achieved through a separate plate also having hook elements and which are snap-fittedly engageable with catch devices integral with the inside channel section such that any of various customized hinge and strike provisions may be provided with any one frame element. The frame element may comprise a unitary member for installation with a fixed wall thickness or, separate inside and outside channel sections slidably overlapping one another to permit accommodation of varying wall thicknesses. In either instance, trim sections normal to the ends of the frame element provide a finish trim overlying the wallboards and this trim may comprise and integral portion of the frame element or include separate, snap-on members.

7 Claims, 1 Drawing Sheet

DOOR FRAME ASSEMBLY

FIELD OF THE INVENTION

This invention relates generally to door frames and more particularly, to an improved door frame assembly having removable and replaceable hinge and strike provisions in combination with a replaceable door stop element, with or without the inclusion of adjustment means permitting accommodating varied wall thicknesses with the same assembly.

BACKGROUND OF THE INVENTION

Metal door frame assemblies, whether adjustable or not, are usually fabricated from sheet metal which is formed to provide one or more components defining inside and outside channels with one such channel formed to provide an integral door stop member. As is well known, that portion of the inside channel adjacent the stop member will serve either as the strike or hinge wall of the channel, depending upon which side of a door opening the respective frame assembly channels are mounted and whether the intended door will be a left-hand or right-hand opening door. Some frame assemblies are manufactured with more or less standard hinge and strike provisions. That is, one channel will be provided with a cutout forming the strike provision and which is adapted to receive the bolt of a door latch. Often, two tapped holes are included adjacent this hole for mounting of a strike plate having an opening aligning with the channel hole. Pre-defined hinge provisions are also common and wherein either two or three specifically spaced apart openings or recesses are provided in a channel, with or without tapped screw bores. These openings or recesses are frequently reinforced by backup plates, particularly when a metal door installation is involved.

In any of the above situations wherein hinge and strike provisions are already supplied, a user is confined to employing doors having hinges and latch/bolt devices precisely matching the size, location and spacing in agreement with the cooperating provisions on the door channels. If a customer decides to use a lighter weight two-hinge door and the contractor has already installed a frame assembly calling for three hinges, it will follow that expensive, disruptive work will be necessary to remove the installed frame assembly and replace it with another, of alternate configuration. Thus, the need will be seen to exist for a frame assembly permitting of ready alteration of the strike and hinge provision without requiring disassembly or modification of the remainder of an installed frame assembly. All the more flexibility will be provided when the foregoing feature is combined with the adjustability of the frame elements to accommodate walls of different thicknesses, along with replaceable door stop and trim cap members.

DESCRIPTION OF THE RELATED ART

The broad concept of adjustable door frames comprising a plurality of components is shown in U.S. Pat. No. 3,420,003 issued to Cline and which includes outer and inner strips slidably interfitting to accommodate varying wall thicknesses and wherein the edge of one strip is slidable beneath a stop element forming an integral part of the other strip. U.S. Pat. No. 3,609,928 issued to Mock illustrates an example of a jamb assembly having both trim elements and a door stop comprising separate components. In this instance, the entire Mock jamb assembly components comprise plastic members and the separate components are snap fitted upon a unitary base member. At least one embodiment in U.S. Pat. No. 4,589,229 issued to Warren illustrates the provision of a distinct door stop member in an otherwise two-piece adjustable jamb assembly. In this referenced example, the stop member comprises a U-shaped member cooperating with a tongue projecting from one piece of the assembly. The unique combination as advanced by the present invention is not seen to be suggested by any combination of the above prior art.

SUMMARY OF THE INVENTION

By the present invention, an improved door frame assembly is provided and wherein a removable and replaceable strike or hinge provision is available, along with a removable door stop. The main frame element may comprise a unitary member providing both inside and outside channels with respective integral trim elements or, a pair of channel members interfitting with one another to accommodate walls of varying thicknesses. Optionally, removable trim elements may be provided. With the above construction, various configurations of either the hinge or strike provision may be mounted upon a channel member, even after the channel members have been installed within the roughened door opening. In this manner, the hinge and strike provisions may be truly customized according to the dictates of each and every door installation. Additionally, at any future time, a different door calling for dissimilar hinge and/or strike provisions, may be readily accommodated without having to replace the entire frame assembly and merely by substituting another hinge and/or strike member.

Accordingly one of the objects of the present invention is to provide an improved door frame assembly including inner and outer channels slidably adjustable to accommodate varying wall thicknesses with one channel removably receiving a snap-fitting plate serving as a replaceable hinge or strike provision.

Another object of the present invention is to provide an improved door frame assembly including a pair of laterally adjustable channels each having an edge member and with one channel provided with snap-fitting means removably receiving a replaceable door stop.

A further object of the present invention is to provide an improved door frame assembly including adjustable inner and outer channels each having an edge member provided with snap-fitting means cooperating with replaceable trim elements.

Still another object of the present invention is to provide an improved door frame assembly including a unitary channel having a stepped portion removably receiving a replaceable hinge or strike plate adjacent a removable door stop member.

With these and other objects in view which will more readily appear as the nature of the invention is better understood, the invention consists in the novel combination and assembly of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENTS

Figure 1:
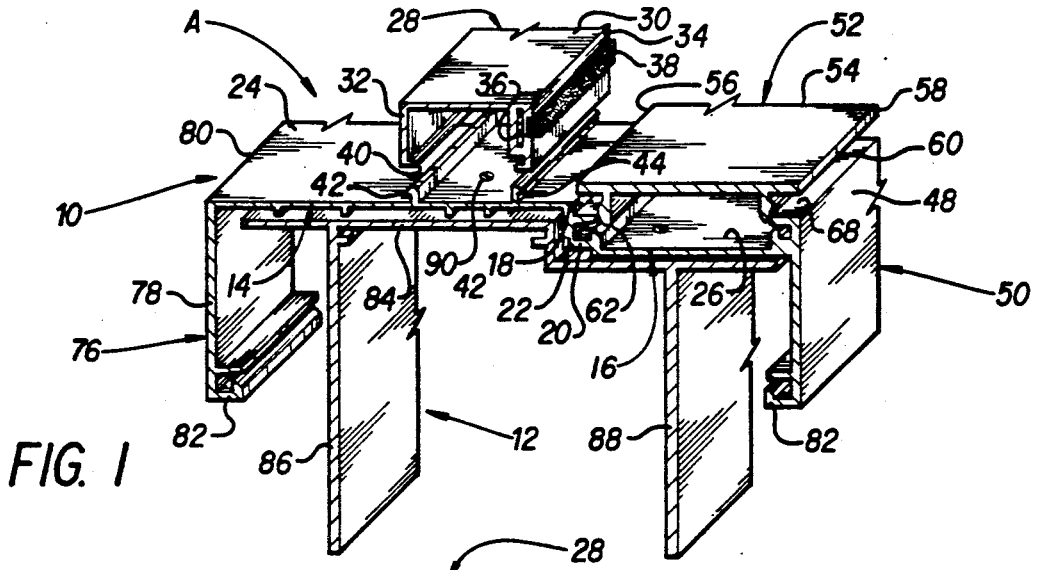
FIG. 1 is an end perspective view, in cross-section, of one form of the present invention.

Referring now to the drawings, the various views will be understood to depict alternative door frame assemblies which may be configured to accommodate walls of varying thicknesses. Each embodiment comprises a plurality of elongated components, preferably formed from sheet metal stock. As is well known in this art, such frames are employed along three sides of a door opening and define a hinge, strike and header channel when installed. In all of the disclosed embodiments, a removable door stop as well as a removable hinge/strike plate are provided. In this manner, any one of the illustrated frame assemblies may be utilized to enclose the three sides of a door opening, with the means permitting attachment of the hinge/strike plate permitting the installation of a customized strike plate within the channel along one side of the opening as well as a customized hinge plate within the same type of channel as applied along the opposite side of the opening. In any case, the same channel construction will be used to form the header channel and wherein an imperforate hinge/strike plate is used.

FIG. 1 depicts a door frame assembly A which is configured to accommodate a specific wall thickness and includes a primary frame element 10 and stud 12, each of which comprises a fixed or unitary member having structural formations adapted to cooperate with one another. The frame element 10 includes an outside channel 14 joined to an inside channel 16. The inner edge 18 of the outside channel is connected to the inner edge 20 of the inside channel by means of an intermediate offset wall 22 which will be seen to be disposed normal to the plane of the faces 24,26 of the channels 14, 16 respectively.

A replaceable door stop member 28 is adapted to be snap-fitted upon the medial area of the frame element 10, adjacent the inner edge 18 of the outside channel face 24. The stop member includes an outer surface 30 bounded by an outer wall 32 and inner wall 34 the latter of which will be seen to be formed with a recess 36 adapted to receive and retain a removable bumper or cushion strip 38. The stop 28 is snap-fittedly attached to the frame element 10 by the interaction of hook elements 40 adjacent the free edges of the stop walls 32,34 and which engage mating recesses on a pair of projections 42,44 extending from the channel face 24. With this arrangement, a stop member 28 may be easily replaced should it become damaged in use and without the necessity of tearing out an entire channel assembly. Likewise, various sizes of stops may be assembled with any one frame element so as to accommodate doors of alternate weights.

The offset or displacement of the plane of the inside channel face 26 will be seen to provide a longitudinal cavity or recess 46 between the offset wall 22 and the face 48 of the inside trim section 50. This cavity 46 serves to accommodate mounting means providing for the snap-fitted attachment of a hinge or strike plate 52. The planar face 54 of this plate is adapted to fully overlie the channel cavity 46 and includes an inner edge 56 abutting the inner edge 18 of the outside channel 14 and an outer edge 58 mating with the corner edge 60 of the inside trim face 48. The plate is retained in the installed position, by means of a pair of preferably continuous hook elements 62,64 engageable with mating projections or ledges 66,68 extending into the cavity 46 of the inside channel 16. Flush disposition of the installed plate 52 is assured as its inside surface 70 flushly abuts and snap-fits against the pair of opposed ledges 66,68 extending respectively from the offset wall 22 and trim section face 48.

With the above described construction it will be appreciated that with any one frame element 10, the plate 52 may be utilized to provide either a strike or hinge provision. The specifics of such provisions need not be dwelled upon herein since numerous hinge and strike provisions are well known to those skilled in this art and the present invention involves the inclusion of a hinge and strike plate which is a separate member, snap-fittingly attached, regardless of the form or attachment of hinges or means adapted to guide a lock bolt during opening and closing of the associated door.

Completing the structure of the frame element 10 is an outside trim section 76 having a face 78 joined to the outside channel 14 at its corner edge 80. Each of the two trim sections 50,76 are provided with an inturned lip 82 at their free edge and which are adapted to engage an underlying wall surface (not shown). The attachment of the door frame assembly A is accomplished by affixing a portion of the frame element 10 to underlying structure defining the door opening. Usually, this structure comprises a stud and the stud 12 as shown in FIG. 1 will be seen to include a stepped outer face or web 84 from which extend a pair of spaced apart flanges 86,88. The fixation of the frame element 10 is most readily achieved by the application of suitable fasteners, such as sheet metal screws 90 and which are driven through the frame element and into the underlying stud web 84. Such fasteners will be seen to be completely masked from view, upon the attachment of the stop 28 and hinge/strike plate 52.

Figure 2:
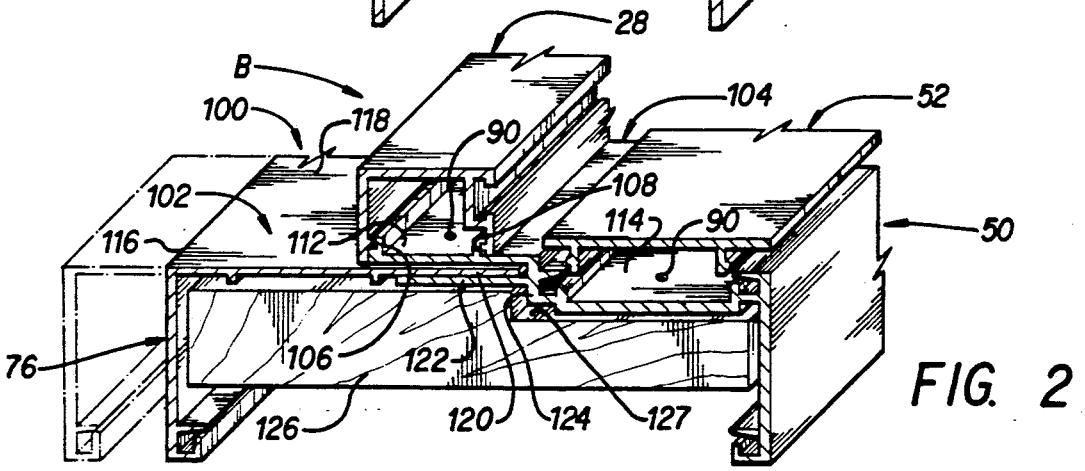
FIG. 2 is a view similar to FIG. 1, of an alternative embodiment.

The door frame assembly B of FIG. 2 employs the removable and replaceable stop and plate features of the above described frame assembly A and adds an adjustability capability in order to accommodate various wall thicknesses with but one primary frame element 100. In this instance, the outside channel 102 will be seen to comprise a member that is separate from the inside channel 104 and the mounting projections 106,108 for attachment of the stop member 110 extend from the first face 112 of the inside channel 104. The second face 114 of the inside channel functions in cooperation with a trim section 50 and hinge/strike plate 52 in a manner similar to that as explained with respect to the FIG. 1 assembly. Likewise, an outside trim section 76 extends from the corner edge 116 of the face 118 of the outside channel 102.

The inner edge 120 of the outside channel face 118 will be seen to be disposed beneath the inside channel first face 112 and with at least its distal portion located within a slot as formed by a flange 122 projecting from the offset wall 124. With this construction, various wall thicknesses may be accommodated by laterally displacing the two channels 102,104 relative one another as reflected by the broken lines in FIG. 2. The frame assembly B may be affixed to either a wooden stud 126 or a metal one as with the stud 12 of FIG. 1 and again, the assembly may be secured as by fasteners 90 passing through the single or double layers of channel elements and into the stud. The stud 126 preferably includes an outer face 127 mating with the configuration of the offset channel faces 114,118.

Figure 3:
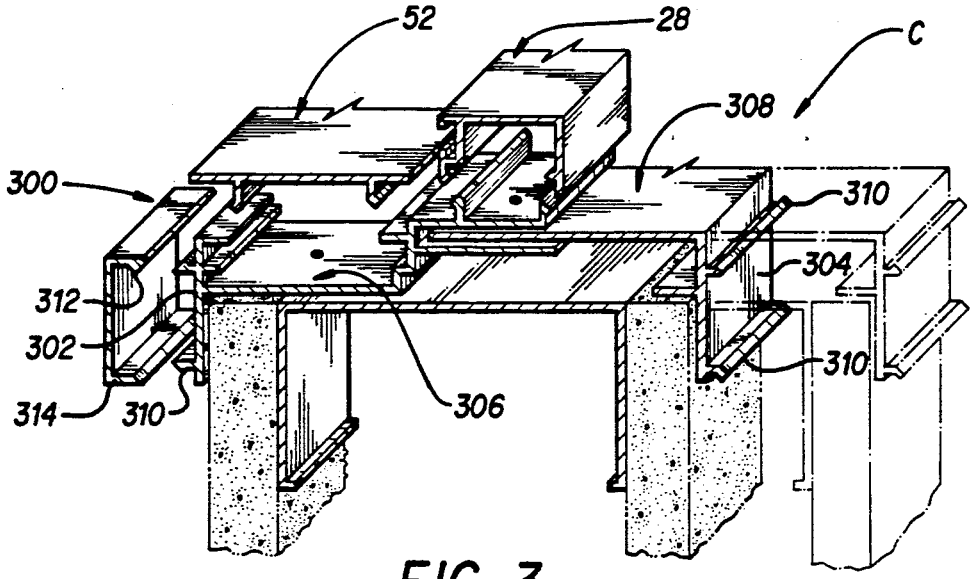
FIG. 3 is a view similar to FIGS. 1 and 2, of still another embodiment.

The door frame assembly C of FIG. 3 depicts a further modification of the adjustable frame assembly B shown in FIG. 2 and wherein removable trim caps 300 are adapted to be snap-fitted upon trim sections 302,304 extending from both the inside channel 306 and outside channel 308. This attachment is accomplished by means of pairs of hook strips 310 projecting from each trim section 302,304 and engageable with catch elements 312 on the side walls 314 of the trim caps 300.

From the foregoing, it will be appreciated that ready means has been provided whereby both the strike and hinge provisions of a door frame assembly may be quickly selected or subsequently altered, through the attachment or replacement of a plate member which is snap-fitted into a position overlying the inside channel of the primary frame element. Likewise, the stop member comprises a separate element that is snap-fitted into place while, the frame element may comprise two separate channel elements with overlying portions permitting accommodation of walls of varying thicknesses.

It is to be understood that the present invention is not limited to the sole embodiments described above, but encompasses any and all embodiments within the scope of the following claims.

I claim:

1. A door frame assembly including:

a primary frame element having inside and outside channels each provided with an outer corner edge, a trim section joined to each said corner edge and disposed substantially normal to said primary frame element, first catch means integral with said primary frame element intermediate said corner edges, a door stop member comprising a separate element and having inner and outer walls provided with respective first hook elements extending mutually inward toward one another from said inner and outer walls, said first hook elements removably engageable by snap action with said first catch means to permit attachment and removal of said door stop member to said primary frame element, second catch means integral with said inside channel, and a hinge plate having second hook elements extending mutually inward toward one another and removably engageable by snap action with said second catch means to permit attachment and removal of said plate to said inside channel of said primary frame element.

2. The door frame assembly according to claim 1 wherein, said inside and outside channels comprise integral portions of said primary frame element.

3. The door frame assembly according to claim 1 wherein, said inside and outside channels comprise separate members having overlapping portions, whereby said primary frame element may be laterally adjusted to accommodate varying wall thicknesses.

4. The door frame assembly according to claim 1 including, third catch means on said trim sections, and removable trim caps having third hook elements cooperating with said third catch means to permit attachment thereof to said trim sections.

5. The door frame assembly according to claim 1 wherein, said inner wall of said door stop member includes cushion means.

6. The door frame assembly according to claim 1 including, a face on said outside channel and a face on said inside channel, an offset wall intermediate said outer and inner channel faces, a corner wall adjacent the outer corner edge of said inside channel, said inside channel face disposed in a plane inwardly offset from said outside channel face and defining a cavity between said offset wall and said corner wall, and said second catch means disposed within said inside channel cavity.

7. The door frame assembly according to claim 6 including, a stud having an outer face substantially mating with said inside and outside channel faces.

* * * * *